US009426558B2

(12) United States Patent
Burt et al.

(10) Patent No.: US 9,426,558 B2
(45) Date of Patent: Aug. 23, 2016

(54) EARPHONE WITH CHASSIS ENCLOSURE

(71) Applicant: Puma North America, Inc., Westford, MA (US)

(72) Inventors: Igor Burt, La Jolla, CA (US); Chad Grismer, San Diego, CA (US)

(73) Assignee: Puma SE, Herzogenaurach (DE)

( * ) Notice: Subject to any disclaimer, the term of this patent is extended or adjusted under 35 U.S.C. 154(b) by 0 days.

(21) Appl. No.: 14/026,283

(22) Filed: Sep. 13, 2013

(65) Prior Publication Data

US 2014/0079271 A1 Mar. 20, 2014

Related U.S. Application Data

(60) Provisional application No. 61/701,045, filed on Sep. 14, 2012.

(51) Int. Cl.
*H04R 25/00* (2006.01)
*H04R 1/10* (2006.01)

(52) U.S. Cl.
CPC ..... *H04R 1/1066* (2013.01); *H04R 1/1016* (2013.01)

(58) Field of Classification Search
CPC ..... H04R 1/10; H04R 1/1066
USPC ..... 381/380, 384, 370, 378, 328
See application file for complete search history.

(56) References Cited

U.S. PATENT DOCUMENTS 5,475,449 A 12/1995 Pyle
6,741,718 B1 5/2004 Brumitt et al.
7,116,793 B2 10/2006 Seto
D543,968 S 6/2007 Wong
7,236,751 B2 6/2007 Ono
D597,069 S 7/2009 Wengreen
7,627,131 B2 12/2009 Nielsen et al.
8,068,633 B2 11/2011 Lee et al.
D652,407 S 1/2012 Groset et al.
8,107,653 B2 1/2012 Wolfe
8,165,332 B2 4/2012 Giese et al.
8,611,581 B2 * 12/2013 Matsuo et al. ..... 381/380
2006/0182297 A1 8/2006 Cyr et al.
2007/0200716 A1 * 8/2007 Haase ..... G08B 15/004 340/574
2008/0170740 A1 * 7/2008 Gantz ..... H04R 1/1058 381/380
2009/0034775 A1 2/2009 Burton
2009/0103762 A1 4/2009 Ishida et al.
2009/0257604 A1 10/2009 Yeates
2010/0104126 A1 4/2010 Greene
2010/0142746 A1 6/2010 Heng
2010/0246878 A1 9/2010 Sim et al.
2011/0019861 A1 1/2011 Wolfe
2011/0051978 A1 3/2011 Chen
2011/0164776 A1 7/2011 Kelly et al.
2011/0268308 A1 11/2011 Vasquez
2011/0290532 A1 12/2011 Cano, Jr.
2011/0317864 A1 * 12/2011 Kaneko ..... H04R 1/1066 381/380
2012/0008814 A1 1/2012 Alwicker et al.
2012/0076340 A1 * 3/2012 Uchida et al. ..... 381/370
2012/0155692 A1 6/2012 Chen

* cited by examiner

*Primary Examiner* — Davetta W Goins
*Assistant Examiner* — Phylesha Dabney
(74) *Attorney, Agent, or Firm* — Brown Rudnick LLP; Mark S. Leonardo

(57) ABSTRACT

The invention generally relates to audio headphones. In certain embodiments, an earbud headphone assembly is provided. The assembly includes a sound chamber and chassis configured to enclose the sound chamber.

6 Claims, 7 Drawing Sheets

EARPHONE WITH CHASSIS ENCLOSURE

RELATED APPLICATION

The present application claims the benefit of and priority to U.S. Provisional Application No. 61/701,045, filed Sep. 14, 2012.

FIELD OF THE INVENTION

The invention generally relates to audio headphones.

BACKGROUND

Typical portable audio devices (i.e., portable MP3 players, cassette players, and CD players) often include a set of headphones that connect to the device. As the headphone industry has progressed, numerous styles of headphones have become available. One of the more popular styles is the earbud style of headphones in which each earbud of the headset is designed to fit within the user's ear. The popularity of the earbud design is attributable to a host of factors, including the relative portability and small size of the earbuds.

Many earbuds consist of at least two parts which come together to form the earbud. The two parts are a base housing which holds the earphone speaker and a rear housing which contains the speaker within the assembled casing and allows the wire carrying the audio signal to be attached to the earphone.

One problem with this design is that if the joining strength of the base housing and rear housing is not strong enough, the two components may detach from one another when subjected to sufficient stress or impact. For example, a user may inadvertently step on the headphones, thus causing the housing components to detach. Another typical occurrence is that the headphones are dropped, which also may result in the rear and base housings coming apart. An earphone is usually used at eye level of a person typically between 1.5-1.8 m tall. However, some earbud casings tend to detach even when dropped from a much lower height of approximately 0.8-0.9 m. Most earphones detach when strained with an impact force of approximately 1.8-2 kg.

Conventional methods used to overcome these problems include the use of ultrasonic bonding or adhesives. In ultrasonic bonding, the base and rear housings are sealed using ultrasonic acoustic vibrations to create a solid-state weld. With adhesives, the housing components are glued together. In either method, the earphone casing is permanently sealed so that the parts of the housing do not detach when dropped. This permanent seal, however, makes the earphone components impossible to service without essentially breaking the unit. Accordingly, there is a need for earbud style headphones with improved resilience to stress that are easier to maintain in the event of detachment.

SUMMARY

The invention generally relates to earbud headphones with a unifying chassis enclosure. Earbud assemblies of the present invention feature a chassis or frame that is used to hold the earphone components, such as the sound chamber, ear pad, and wire together without the use of adhesives or ultrasonic welding. The chassis acts a unifying enclosure to hold the various components together when the earphone is subjected to various types of stress, including being dropped or stepped on.

Any material in the art can be used to prepare the chassis, however, preferred embodiments of the invention use plastic or a plastic composite. In certain aspects, the material will be a semi-hard plastic which affords some degree of flexibility and provides further resilience to stress or impact.

Because the chassis is more or less a frame, a substantial portion of the enclosed components may be exposed. In other words, a substantial portion of one or more of the enclosed components, such as the sound chamber, may extend beyond the chassis. This is desirable when the sound chamber is used for other purposes, such as helping secure the assembly in the ear. The chassis, however, may also include an aperture through which an end of the sound chamber can extend through.

The chassis is configured to include two ends which can come together to form a closed loop and separate to form an open loop. Accordingly, the provided chassis is able to switch back and forth from a closed loop position to an open loop position. The two ends may be positioned at the bottom of the chassis away from the position of the ear pad. In certain embodiments, the wire that connects the sound chamber to the audio device travels out the two ends of the chassis.

The provided earbud assembly may also include a chassis cap that locks the chassis in the closed position. The chassis cap can be prepared from any material known in the art, however, in certain aspects, the chassis cap is made of plastic. The chassis cap is able to slide up the two aforementioned chassis ends, pushing them together and keeping the chassis in a closed loop position. In certain aspects, each chassis end includes notch that facilitates holding the chassis cap in the desired position.

Accordingly, an earbud assembly is provided. The assembly also includes a sound chamber and a chassis configured to enclose the sound chamber. In certain aspects, the chassis is made of plastic or a plastic composite. The chassis includes two chassis ends. The chassis forms a closed loop when the ends are brought together and an open loop when the ends are separated. In certain aspects, the chassis ends are positioned at the bottom of the chassis at a region away from the ear pad. In certain embodiments, the assembly further includes a chassis cap configured to hold the two chassis ends together. The chassis cap, in certain aspects, is made of plastic. In certain embodiments, the ends of the chassis have notches configured to hold the chassis cap in place. In some aspects, the assembly also includes an ear pad adapted to fit within the ear of the user.

Headphone assemblies in accordance with the invention offer numerous benefits. The use of the chassis provides a secure enclosed construction. The chassis acts as a unifying enclosure to hold the various components securely in place when subjected to stress. In addition, because the chassis can be opened or closed, the various components held together by the chassis can exchanged, upgraded, or repaired as desired without having to replace the entire earbud. In this manner, the provided earbud assembly is easy to repair, maintain, and customize. Additional features and advantages of exemplary implementations of the invention will be set forth in the following description.

DETAILED DESCRIPTION

Figure 1A:
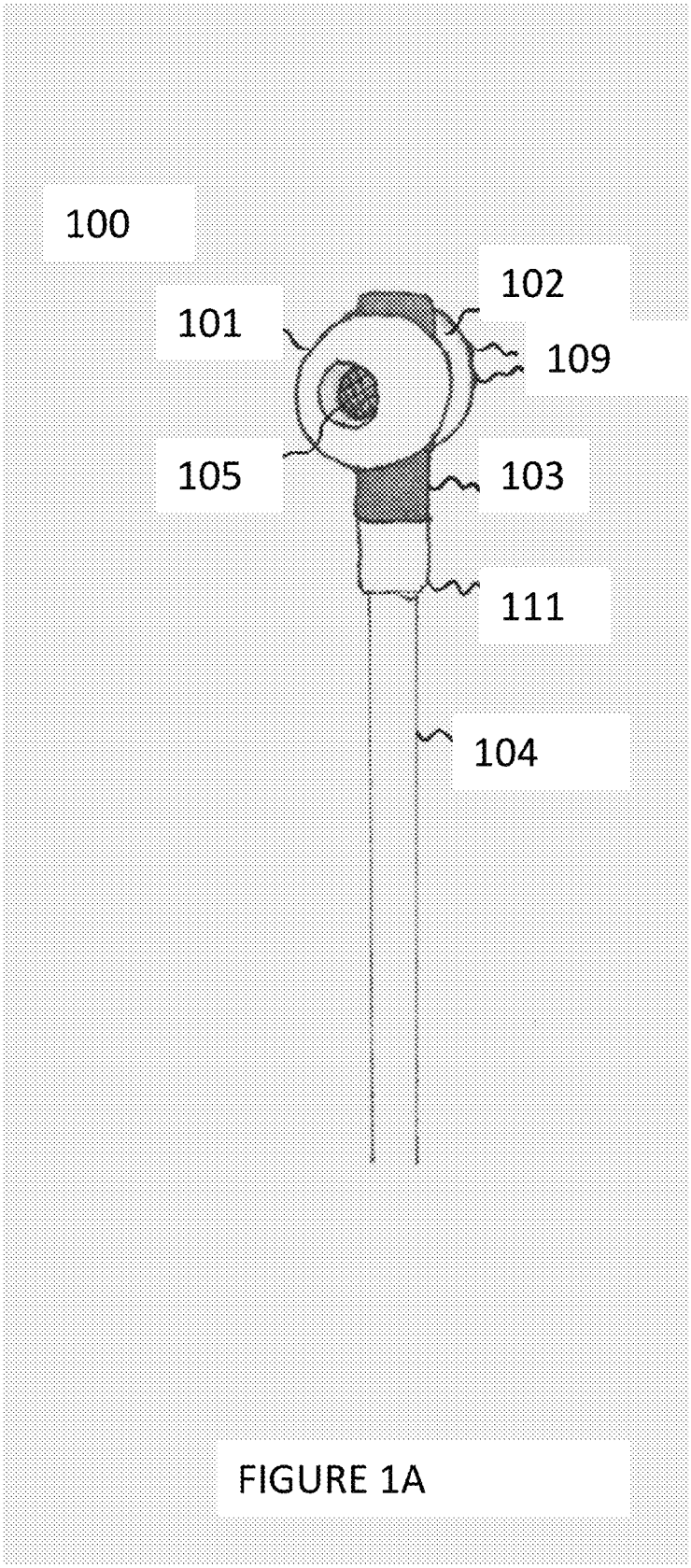
FIGS. 1A, 1B, and 1C are front, side, and rear views, respectively, of an embodiment of the invention.

The invention provides an earbud headphone assembly encompassing a chassis that holds various components of the assembly together. This unifying chassis holds the components securely together when the assembly is subjected to stress or impact. The chassis also facilitates the convenient maintenance and repair of the assembly. In some embodiments, the assembly includes a sound chamber and a chassis configured to enclose the sound chamber.

The sound chamber is typically a cylindrical component configured for insertion into the ear. The appropriate size can be determined empirically by those skilled in the art.

The body of the sound chamber can be prepared from any suitable material. In certain embodiments, the body of the sound chamber is prepared from plastic or a plastic polymer. The sound chamber may house a speaker capable of converting an audio signal into an audible sound wave. Accordingly, the sound chamber can receive an audio signal from the audio device and convert it into sound. The sound chamber may include components such as coils, magnets, drivers, cones, electronics, and electrical connections that assist in the conversion of the audio signal into an audible sound wave. The exact configuration of these components required in order to produce sound is well-known in the art.

In addition to the internal components, the sound chamber can also include various external components. For example, the sound chamber may include a mesh speaker cover. The mesh speaker cover can be prepared from a variety of materials, including aluminum or plastic. Other embodiments may replace the mesh cover with an open port from which sound exits the chamber. The sound chamber may also be connected to a wire that delivers audio signal from the playback device to the speaker within the sound chamber.

In certain embodiments, the sound chamber features a region that grips the outer ear when the unit is placed within the ear. In certain aspects, the region is a circular band that extends around the circumference of the sound chamber, thus giving the grip region a "scallop" appearance. This grip region is configured such that a substantial portion of the region contacts the ear, thereby securing the earbud assembly in the ear when placed inside. In preferred embodiments, the grip region is prepared from a material that is able to provide some resistance when moved. Accordingly, the material helps the earpiece from falling out the ear. In some instances, the material is able to resist movement due to friction. In some embodiments, the movement-resistance material is a band of material that extends around the entire circumference of the sound chamber, thus providing the assembly with a "scallop" grip. In some embodiments, however, the material extends over less than the total circumference of the sound chamber. As long as an adequate portion of the grip region is able to contact the ear, a grip region of smaller area will not interfere with its intended use.

The movement-resistant material of the grip region can be prepared from any material known in the art suitable for providing grip and impeding movement. In some embodiments, the movement-resistant material is a rubber or a rubber composite, such as silicone rubber.

The movement-resistant material may also include a plurality of protrusions that extend from the surface of the material. The protrusions further secure the device in the ear and resist movement. In some instances, the protrusions are uniformly positioned over the movement-resistant material. In other instances, each protrusion constitutes a ridge that extends along the length of the movement-resistant material.

As contemplated by the invention, the sound chamber along with grip region is configured such that a substantial portion of the grip zone contacts the ear. Accordingly, when the assembly is placed inside the ear, a significant portion of the grip region contacts the outer ear, thereby securing the device in the ear. Therefore, in contrast to conventional earbud headphones, which typically rely on just the ear pad itself to secure the earbud in the ear, the provided assemblies offer an additional surface, i.e., the grip region, to secure the unit in the ear. In certain embodiments, the grip region placed on the sound chamber is configured to be slightly larger than the typical human outer ear, which facilitates securing the device in the ear.

As mentioned above, the movement-resistant material may constitute a band that surrounds the sound chamber. To better accommodate the band, the sound chamber may have a depression, notch, or groove along its surface which accommodates the band. In other embodiments, the sound chamber does not feature the depression and the band simply wraps around the sound chamber without additional accommodation.

The assembly may also include a chassis which encloses the sound chamber and the grip region. Any material known in the art can be used to prepare the chassis. In certain aspects, chassis is made from plastic or a plastic composite. In a further aspect, the material is a semi-hard plastic which provides some degree of flexibility. The use of such semi-hard materials enhances the overall resilience of the assembly. The use of a somewhat flexible material also facilitates the ability to open the chassis when needed, which is explained in further detail below.

The chassis contemplated by the invention is essentially a frame. While the frame encloses and secures the various components, a substantial portion of the enclosed components may not be covered by the frame. In other words, a substantial portion of one or more of the enclosed components, such as the sound chamber, may extend beyond the chassis. This is desirable when the sound chamber is used for other purposes, such as helping secure the assembly in the ear, as explained above.

In certain embodiments, the chassis includes an aperture. The aperture allows a portion of the enclosed sound chamber to extend through the chassis. In this manner, the sound chamber may remain enclosed in the chassis, but a component outside the chassis, such as an ear pad, can still connect to the sound chamber.

The chassis is configured to include two ends. In some embodiments, the ends are positioned at the bottom of the chassis away from the ear pad. Placing the ends together closes the chassis while separating the ends opens the chassis. Accordingly, the chassis can form a closed or open loop through control of the ends. When in the closed position, the chassis provides a secure housing for the various components. In the open position, the various components can be easily accessed for repair, upgrades, or customization. In further embodiments of the invention, the wire that connects the sound chamber to the audio device exits the assembly through the two ends of the chassis.

In certain embodiments, the provided earbud assembly also includes a chassis cap which locks the chassis in a closed position. The chassis cap can be prepared from any material known in the art. In certain aspects, however, the chassis cap is made of plastic or a plastic composite. Once the chasses ends have been placed together, the cap can slide up them, pushing them further together and keeping the chassis in a closed loop position. In certain aspects, the ends of the chassis are equipped with notches that prevent the cap from falling back once it is placed in the desired position.

Further embodiments of the invention include an ear pad adapted to fit into an ear. In contrast to conventional earbud headsets, which usually rely on just the ear pad to secure the unit within the ear, the assemblies of the present invention offer an additional surface to stabilize the unit, i.e., the grip region featured on the sound chamber. The ear pad of the present invention is configured to be slightly larger than the typical human outer ear. The appropriate size may be determined empirically by those skilled in the art. Moreover, standard sizes for ear pads in headphone assemblies are well-known in the art.

The ear pad can be prepared from any material known in the art suitable for insertion into the ear, but in general, the ear pad is made from a semi-hard material with a certain amount of flexibility. In certain embodiments, the ear pad is made from rubber or a rubber composite, such as silicone rubber. The hardness of the ear pad is preferably any of 30, 40, and 50 degrees as measured with the JIS hardness scale.

The ear pad is connected to one end of the sound chamber. In certain embodiments, the sound chamber may be equipped with notches or grooves to secure the ear pad onto the sound chamber. The ear pad itself may also include notches or grooves to secure the ear pad onto the sound chamber.

Figure 1B:
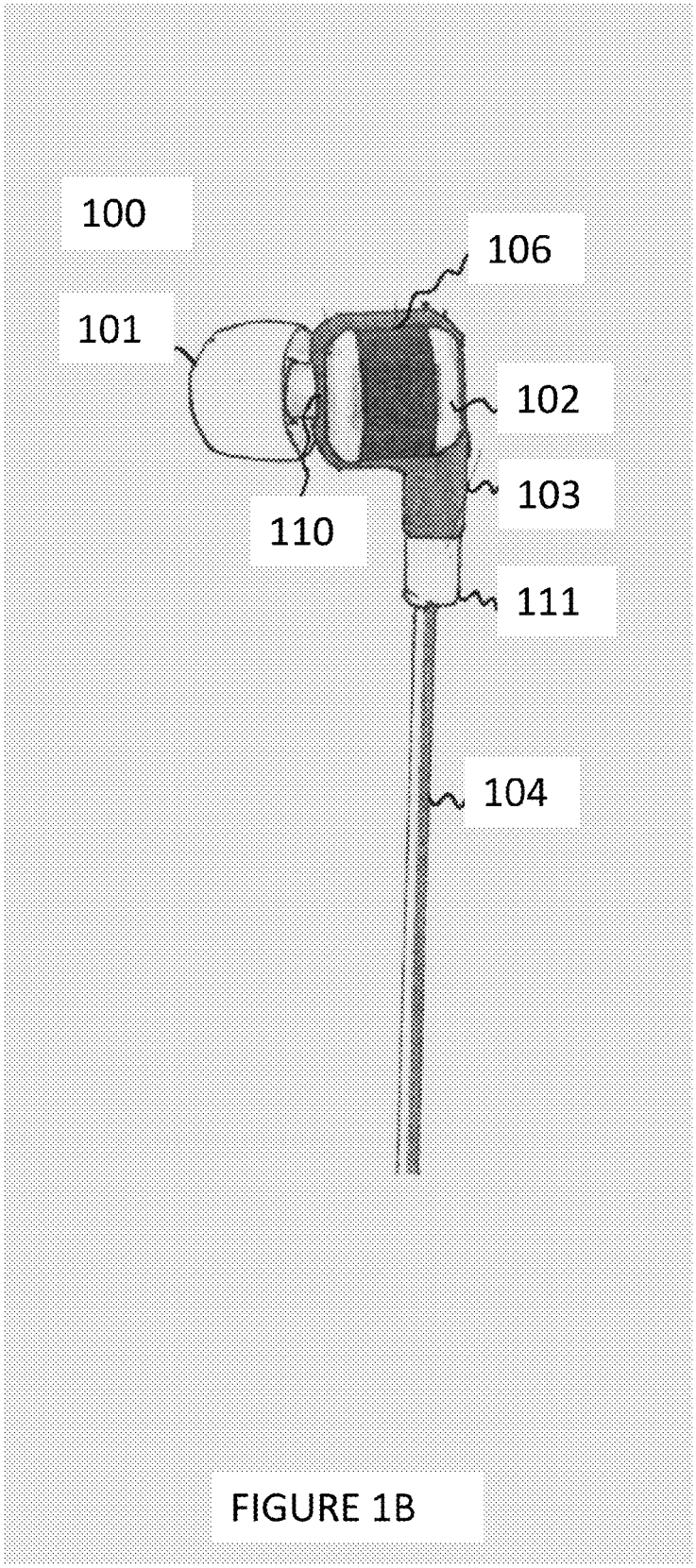
Figure 1C:
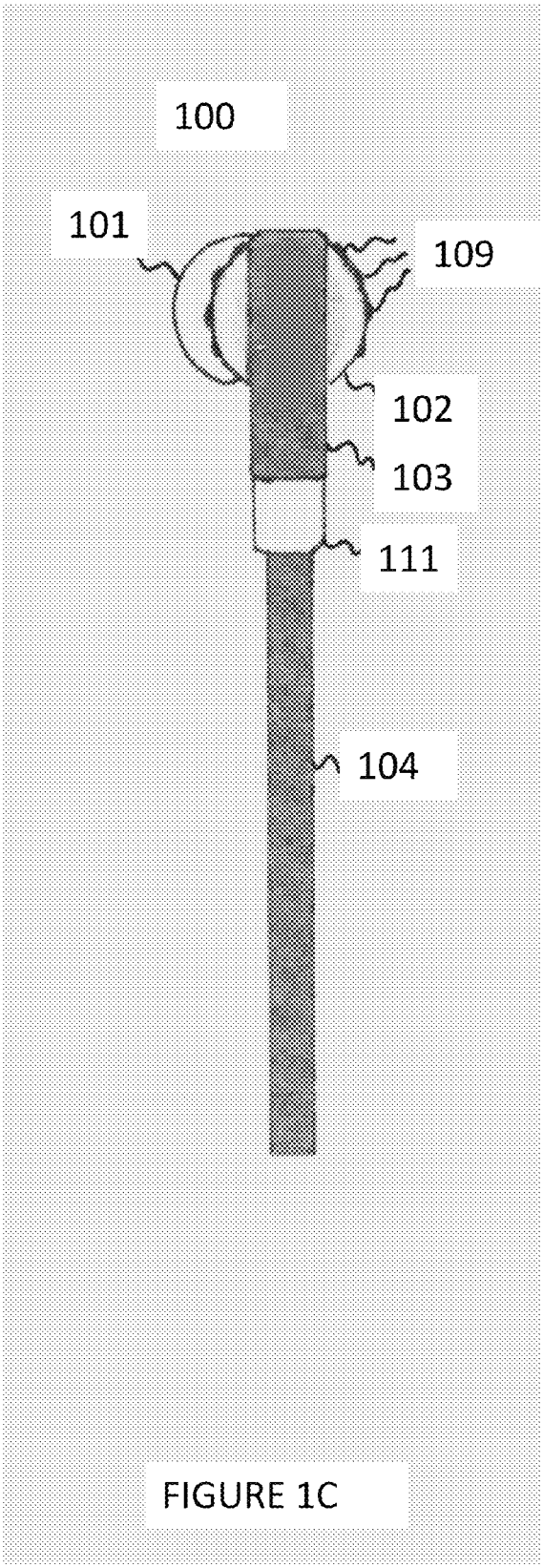

An exemplary assembly 100 of the invention is provided in FIGS. 1A, 1B, and 1C, depicting front, side, and rear views, respectively. The assembly 100 provided in FIGS. 1A-C depicts an ear pad 101 connected to a sound chamber 102 enclosed in a chassis 103. A chassis cap 111 maintains the chassis in a closed position. The chassis contains an aperture 110 which allows a portion of the sound chamber to extend out the aperture 110. A wire 104 travels from sound chamber 102 through a bottom region of the chassis 103 for connection to an audio device. In this assembly 100, the sound chamber 102 has a mesh cover 105 at the end where sound travels out the chamber 102. Surrounding the sound chamber 102 is a band 106 of movement-resistant material, which serves to secure the earphone assembly 100 within the ear. In this embodiment, the band has a plurality of ridges 109 on the surface, which further serve to secure the assembly 100 in the ear. As shown in FIGS. 1A-C, the chassis 103 allows a significant portion of the sound chamber 102 and band 106 to be exposed, thus maximizing contact between the assembly 100 and the ear.

Figure 2:
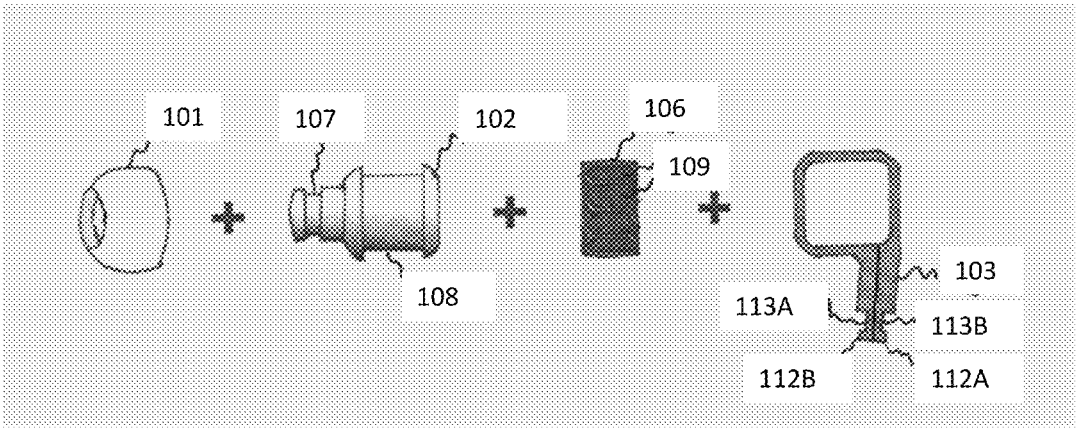
FIG. 2 is an exploded perspective of an embodiment of the invention.

An exploded view of an exemplary assembly 100 of the invention is provided in FIG. 2. As shown, the assembly 100 includes an ear pad 101, a sound chamber 102, a band 106 of movement-resistant material, and a chassis 103. The sound chamber 102 features a first notch 107 to facilitate connection of the ear pad 101 and a second notch 108 to accommodate the movement-resistant band 106. As shown, the band 106 comprises ridges 109 that extend along the length of the band 106. The chassis 103 as shown in this embodiment is essentially a frame with sufficient space therein for accommodating the sound chamber 102 and band 106, while still permitting maximum exposure of the band 106 to an outside surface, such as an ear.

Figure 3A:
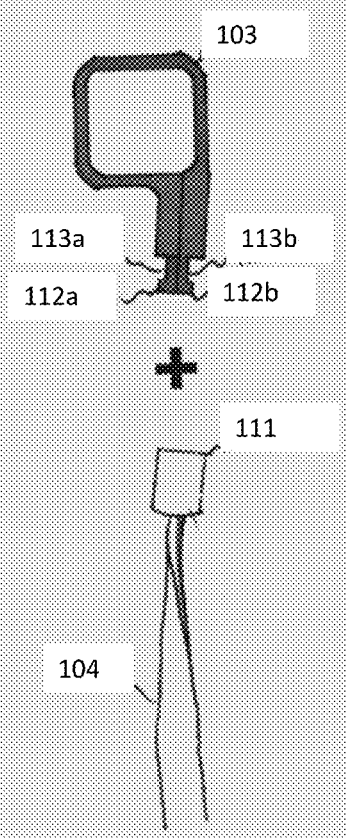
FIG. 3A presents an exemplary chassis in closed position along with a chassis cap for locking the chassis in the closed position.
Figure 3B:
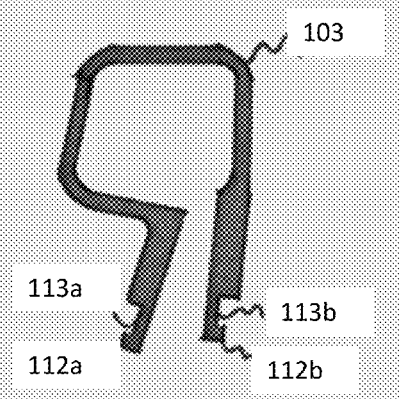
FIG. 3B depicts an exemplary chassis in an open position.

Another perspective of the chassis is provided in FIGS. 3A and 3B. FIG. 3A depicts the chassis 103 in a closed position with the two ends 112*a* and 112*b* of the chassis 103 close together. With the ends 112*a* and 112*b* close together, the cap 111 can move up the ends 112*a* and 112*b* to lock the chassis 103 in a closed position. Notches 113*a* and 113*b* within the chassis ends 112*a* and 112*b* prevent the cap 111 from falling back down. In this embodiment, the chassis cap is also attached to the wire 104 that connects to the audio device.

FIG. 3B depicts the chassis 103 in an open position with the chassis ends 112*a* and 112*b* separated from one another. With the chassis open, components of the assembly can be removed and replaced if necessary.

Figures 4A, 4B, 4C:
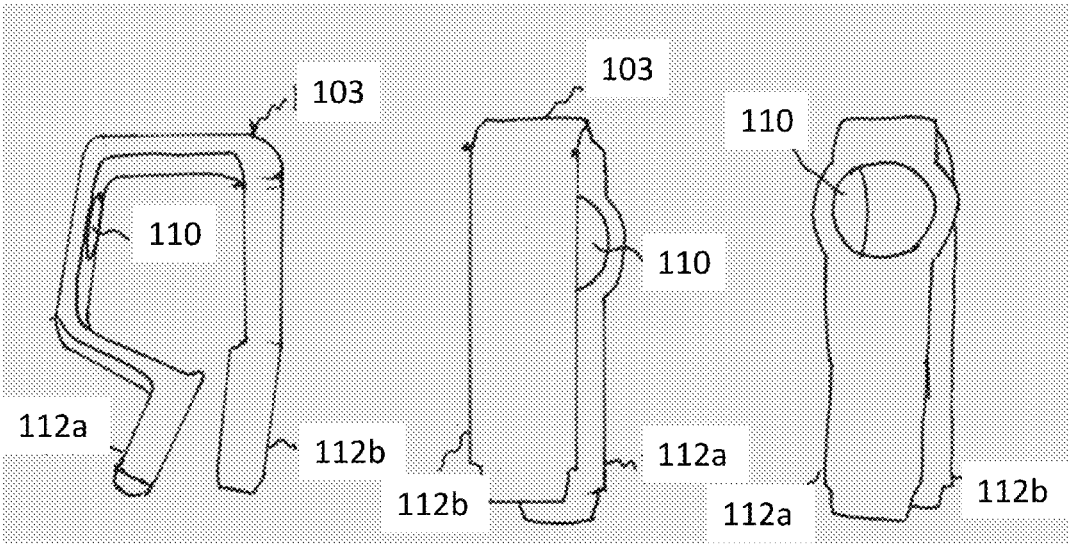
FIGS. 4A, 4B, and 4C are side, rear, and front views, respectively, of an exemplary chassis.

Yet another perspective of the chassis is provided in FIGS. 4A, 4B, and 4C, depicting side, rear, and front views, respectively. In all views, the chassis 103 is in an open position. As shown, the chassis 103 has an aperture 110 in which the sound emitting end of the sound chamber 102 can extend through. In this particular embodiment, the chassis ends 112*a* and 112*b* do not have notches but when placed together, can still be held in a closed position by a chassis cap.

Figure 5A:
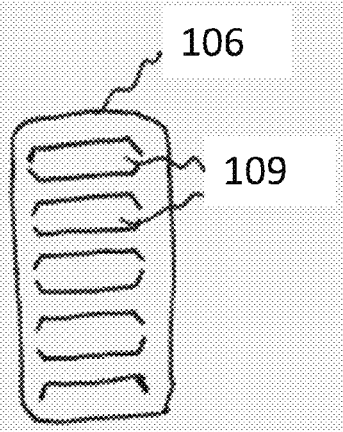
FIGS. 5A and 5B are side and front views, respectively, of an exemplary movement-resistant band.
Figure 5B:
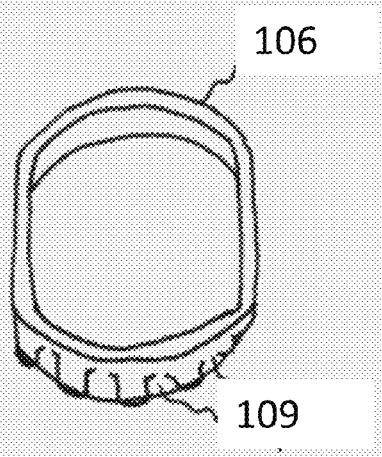

Another perspective of the movement resistant band is provided in FIGS. 5A and 5B, depicting side and front views, respectively. As shown, the band, 106 features ridges 109 that extend along the length of the band 106. In this embodiment, the ridges 109 are uniformly distributed along the band 106. Although in preferred embodiments, the band 106 is prepared from a movement-resistant material, such as rubber, the ridges 109 further stabilize the band 106 once it is placed in the ear.

In light of the figures, the benefits of the invention are apparent. The chassis acts as a unifying enclosure able to hold the sound chamber, grip band, and wire securely in place when the assembly is subjected to stress or impact. In addition, the assembly allows the interchanging, customization, or upgrading of the various components without having to replace the entire unit. In addition, because the various components are held together by the chassis, there is no need for adhesive or welding, which facilitates access for maintenance purposes.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

The invention may be embodied in other specific forms without departing from the spirit or essential characteristics thereof. The foregoing embodiments are therefore to be considered in all respects illustrative rather than limiting on the invention described herein. Scope of the invention is thus indicated by the appended claims rather than by the foregoing description, and all changes which come within the meaning and range of equivalency of the claims are therefore intended to be embraced therein.

What is claimed is:

1. An earbud headphone assembly comprising:

a sound chamber;

an ear pad connected to the sound chamber, wherein the ear pad is adapted for insertion into an ear;

a chassis formed from a single piece of material, the chassis comprising:

a first end;

a second end configured to mate with the first end; and a body member extending from the first end to the second end and configured to removably enclose the sound chamber;

wherein the chassis is configured to transition from a closed position, in which the first end is adjacent to the second end, to an open position, in which the first end is separated from the second by a distance; and a chassis cap configured to maintain the chassis in the closed position.

2. The earbud headphone assembly of claim 1, wherein the chassis cap is plastic.

3. The earbud headphone assembly of claim 1, wherein the chassis is plastic.

4. The earbud headphone assembly of claim 3, wherein the plastic is a semi-hard plastic.

5. The earbud headphone assembly of claim 1, wherein the chassis includes an aperture configured to allow a portion of the sound chamber to extend out the chassis.

6. The earbud headphone assembly of claim 1, wherein the first and second ends form a bottom portion of the chassis.

* * * * *